United States Patent [19]

Ishida et al.

[11] Patent Number: 4,659,643

[45] Date of Patent: Apr. 21, 1987

[54] HEAT-SENSITIVE RECORDING DIAZO MATERIAL WITH RECORDING SENSITIZER

[75] Inventors: Katsuhiko Ishida, Takatsuki; Masaharu Nojima, Amagasaki; Tosaku Okamoto, Osaka, all of Japan

[73] Assignee: Kanzaki Paper Manufacturing Co. Ltd., Tokyo, Japan

[21] Appl. No.: 789,710

[22] Filed: Oct. 21, 1985

[30] Foreign Application Priority Data

Oct. 27, 1984 [JP] Japan ..... 59-226186

[51] Int. Cl.[4] ..... G03C 1/60; G03C 1/54

[52] U.S. Cl. ..... 430/157; 430/158; 430/162; 430/177; 430/179; 430/151; 346/208; 346/218

[58] Field of Search ..... 430/177, 179, 151, 158, 430/162, 157; 346/208, 218

[56] References Cited

U.S. PATENT DOCUMENTS

| | | | |
|---|---|---|---|
| 3,255,007 | 6/1965 | Kosar | 430/151 |
| 3,642,483 | 2/1972 | Kubo et al. | 430/151 |
| 4,400,456 | 8/1983 | Matsuda et al. | 430/151 |
| 4,411,979 | 10/1983 | Nagamoto et al. | 430/177 |
| 4,497,887 | 2/1985 | Watanabe et al. | 430/151 |
| 4,531,140 | 7/1985 | Suzuki et al. | 346/208 |

FOREIGN PATENT DOCUMENTS

| | | | |
|---|---|---|---|
| 58-51186 | 3/1983 | Japan . | |
| 58-63934 | 4/1983 | Japan | 430/151 |
| 59-93385 | 5/1984 | Japan . | |
| 840945 | 2/1957 | United Kingdom | 430/151 |

*Primary Examiner*—Charles L. Bowers, Jr.
*Attorney, Agent, or Firm*—Murray and Whisenhunt

[57] ABSTRACT

A heat-sensitive recording material comprising a substrate and a heat-sensitive recording layer thereon, the heat-sensitive recording layer containing a diazonium salt, coupler compound, heat-fusible basic compound and at least one of the compounds represented by the formula [I] below

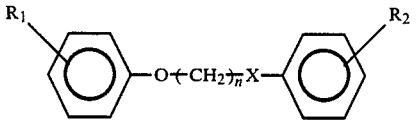

[I]

wherein X is —O— or —CONH—, $R_1$ and $R_2$ are each hydrogen, halogen, alkyl having 1 to 8 carbon atoms, cycloalkyl, aryl, aralkyl or alkoxyl and n is an integer of 1 to 10.

4 Claims, No Drawings

HEAT-SENSITIVE RECORDING DIAZO MATERIAL WITH RECORDING SENSITIZER

The invention relates to a heat-sensitive recording material, and more particularly to a heat-sensitive recording material which is fixable with light.

Heat-sensitive recording materials are well known which are adapted to produce record images by thermally contacting a colorless basic dye with a color acceptor for a color forming reaction.

Since the above heat-sensitive recording materials form record images with heat, they produce a color, even after printing, in portions which are heated with an inadvertent access of heat sources. As a result, they have a disadvantage that the printed letters could become illegible and thus hardly applicable to an important use in which the printed document has to be preserved.

In recent years, therefore, fixable heat-sensitive recording materials which utilize a color forming reaction between a diazonium salt and coupler compound have been developed.

Generally, in the diazo-type heat-sensitive recording materials are dispersed a diazonium salt, coupler compound and heat-fusible basic compound in a recording layer in discrete particle state, and record images are obtained with heat.

On heating the recording layer of this type of heat-sensitive recording material, the heat-fusible basic compound causes color forming reaction of the diazonium salt with the coupler compound to give record images. Thereafter the entire surface of the recording layer is irradiated with ultraviolet rays to decompose the unreacted diazonium salt in the unrecorded portion of the recording layer. The decomposition of the unreacted diazonium salt eliminated the possibility of color forming reaction occurring on application of heat, whereby the record images are fixed. The recording material, however, requires a high temperature for a color formation and is unsuitable to a high-speed recording.

With remarkable progress in heat-sensitive recording systems such as thermal facsimile systems, thermal printer systems of electrocomputers or analysing devices for medical use, vending systems of commutation tickets or railroad tickets, these heat-sensitive recording systems are made operable at a high speed. For use with such high-speed hardware, heat-sensitive recording materials must meet the requirements of having a high recording sensitivity. Various methods have been proposed to enhance the recording sensitivity by adding a recording sensitizer such as a higher fatty acid amide, etc. to the recording layer. The recording materials become improved in the recording sensitivity with use of conventional recording sensitizer, but have drawbacks to become low in the storage stability and color in the recording layer with a lapse of time.

An object of the invention is to provide a diazo-type heat-sensitive recording material having an improved high-speed recording sensitivity and an excellent storage stability over a long period of time.

The above and other objects of the invention will become apparent from the following description.

The present invention provide a heat-sensitive recording material comprising a substrate and a heat-sensitive recording layer thereon, the heat-sensitive recording layer containing a diazonium salt, coupler compound, heat-fusible basic compound and at least one of the compounds represented by the formula [I] below

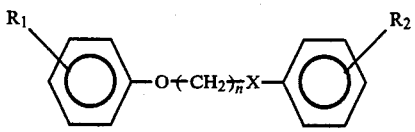

[I]

wherein X is —O— or —CONH—, $R_1$ and $R_2$ are each hydrogen, halogen, alkyl having 1 to 8 carbon atoms, cycloalkyl, aryl, aralkyl or alkoxyl and n is an integer of 1 to 10. Examples of alkyl groups are methyl, ethyl, butyl, hexyl, octyl, etc. Cycloalkyl groups include cyclopentyl, cyclohexyl, cycloheptyl, etc., aryl groups include phenyl, tolyl, xylyl, naphthyl, etc., aralkyl groups include benzyl, phenethyl, phenylpropyl, etc., and alkoxyl groups include methoxy, ethoxy, propoxy, hexyloxy, octyloxy, etc.

As examples of the above specific recording sensitizer, the following compounds are enumerated which are not restricted.

1-(2-Phenylphenoxy)-2-phenoxyethane (mp 96° C.), 1-(4-phenylphenoxy)-2-(2-methylphenoxy)ethane (mp 110° C.), 1,4-diphenoxybutane (mp 99° C.), 1,4-di(4-methylphenoxy)butane (mp 104° C.), 1-(4-phenylphenoxy)-3-phenoxypropane (mp 94.5° C.), 1-phenoxy-2-(4-tert-butylphenoxy)ethane (mp 93° C.), 1,2-diphenoxyethane (mp 96° C.), 1-(2-methylphenoxy)-2-phenoxyethane (mp 71.5° C.), 1-(3-methylphenoxy)-2-phenoxyethane (mp 76° C.), 1-(4-methylphenoxy)-2-phenoxyethane (mp 99.5° C.), 1-(4-ethylphenoxy)-2-phenoxyethane (mp 107° C.), 1-(4-isopropylphenoxy)-2-phenoxyethane (mp 94° C.), 1-(4-tert-butylphenoxy)-2-phenoxyethane (mp 92° C.), 1,2-di(2-methylphenoxy)ethane (mp 84° C.), 1-(4-methylphenoxy)-2-(2-methylphenoxy)ethane (mp 88.5° C.), 1-(4-ethylphenoxy)-2-(2-methylphenoxy)ethane (mp 77° C.), 1-(4-isopropylphenoxy)-2-(2-methylphenoxy)ethane (mp 87° C.), 1-(4-tert-butyl-phenoxy)-2-(2-methylphenoxy)ethane (mp 96° C.), 1,2-di(3-methylphenoxy)ethane (mp 98° C.), 1-(4-methylphenoxy)-2-(3-methylphenoxy)ethane (mp 94° C.), 1-(4-ethylphenoxy)-2-(3-methylphenoxy)ethane (mp 106° C.), 1-(4-isopropylphenoxy)-2-(3-methylphenoxy)ethane (mp 83.5° C.), 1-(4-tert-butylphenoxy)-2-(3-methylphenoxy)ethane (mp 89.5° C.), 1,2-di(4-methylphenoxy)ethane (mp 135° C.), 1-(4-ethylphenoxy)-2-(4-methylphenoxy)ethane (mp 134° C.), 1-(4-(isopropylphenoxy)-2-(4-methylphenoxy)ethane (mp 116° C.), 1-(4-tert-butylphenoxy)-2-(4-methylphenoxy)ethane (mp 118° C.), 1,3-di(4-methylphenoxy)propane (mp 93.5° C.), 1-(2-chlorophenoxy)-2-phenoxyethane (mp 81° C.), 1-(2-chlorophenoxy)-2-(2-methylphenoxy)ethane (mp 87° C.), 1-(2-chlorophenoxy)-2-(3-methylphenoxy)ethane (mp 85° C.), 1-(2-chlorophenoxy)-2-(4-methylphenoxy)ethane (mp 89° C.), 1-(4-chlorophenoxy)-2-phenoxyethane (mp 100° C.), 1-(4-chlorophenoxy)-2-(2-methylphenoxy)ethane (mp 81.5° C.), 1-(4-chlorophenoxy)-2-(3-methylphenoxy)ethane (mp 79.5° C.), 1-(4-chlorophenoxy)-2-(4-methylphenoxy)ethane (mp 132° C.), 1-(2-methoxyphenoxy)-2-(4-methylphenoxy)ethane (mp 89° C.), 1-(3-methoxyphenoxy)-2-(4-methylphenoxy)ethane (mp 75° C.), 1,2-di-(4-methoxyphenoxy)ethane (mp 128° C.), 1-(4-methoxyphenoxy)-2-phenoxyethane (mp 103° C.), 1-(4-methoxyphenoxy)-2-(2-methylphenoxy)ethane (mp 80° C.), 1-(4-methoxyphenoxy)-2-(3-methylphenoxy)ethane (mp 112° C.), 1-(4-methoxyphenoxy)-2-(4-methylphenoxy)ethane (129° C.), 1-(4-cyclohexylphenoxy)-2-phenoxyethane (mp 116° C.), 1-(4-chlorophenoxy)-2-(4-tert-butylphenoxy)ethane (mp 111° C.), 1-(4-methoxyphenoxy)-2-(4-tert-butylphenoxy)ethane (mp 109.5° C.), 1-(4-methoxyphenoxy)-4-phenoxybutane (mp 100° C.), phenoxyacetanilide (mp 101° C.), etc.

Further, the following compounds are also used as the recording sensitizer in the invention. 1-(4-Isoamylphenoxy)-2-phenoxyethane, 1-(4-tert-amylphenoxy)-2-(3-methylphenoxy)ethane, 1-(4-neopentylphenoxy)-3-phenoxypropane, 1-(3-neohexylphenoxy)-2-(3-methylphenoxy)ethane, 1-(3-methoxyphenoxy)-2-phenoxyethane, 1,2-di(3-methoxyphenoxy)ethane, 1-(3-methoxyphenoxy)-2-(3-ethylphenoxy)ethane, 1-(4-ethoxyphenoxy)-2-phenoxyethane, 1-(3-ethoxyphenoxy)-2-(3-ethylphenoxy)ethane, 1-(3-propyloxyphenoxy)-2-phenoxyethane, 1,3-di(4-propyloxyphenoxy)propane, 1-(3-tert-butoxyphenoxy)-2-(3-methylphenoxy)ethane, 1-(4-bromophenoxy)-2-phenoxyethane, 1-(3-bromophenoxy)-2-phenoxyethane, 1-(4-benzylphenoxy)-2-phenoxyethane, 1-(3-methylphenoxy)-5-(3-ethylphenoxy)pentane, 1,5-diphenoxypentane, 1,6-diphenoxyhexane, 1-(4-methylphenoxy)-6-phenoxyhexane, 1,8-diphenoxyoctane, 1,8-di(3-methylphenoxy)octane, etc.

Among the above compounds, preferable are those having the formula

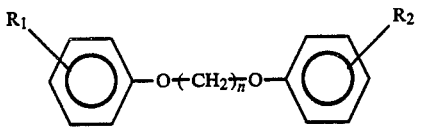

[I']

$R_1$ and $R_2$ are each hydrogen, halogen, alkyl having 1 to 8 carbon atoms, cycloalkyl, aryl, aralkyl or alkoxyl and n is an integer of 1 to 10. The compound of the formula [I'] can be easily synthesized and affords a recording material which is less colored with a lapse of time and is excellent in storage stability.

Further, more preferable are those having the formula [I'] in which $R_1$ and $R_2$ are each hydrogen, chlorine, alkyl having 1 to 4 carbon atoms, phenyl, benzyl or alkoxyl having 1 to 4 carbon atoms and n is an integer of 1 to 4. These compound can provide a recording material which is extremely less colored with a lapse of time and is excellent in recording sensitivity.

These recording sensitizers can generally be prepared by Williamson's synthesis of ether and are usable singly or in a mixture of at least two of them.

Further, to the recording layer may be added in an amount which does not cause adverse effect, fatty acid amide such as stearic acid amide, stearic acid methylenebisamide, oleic acid amide, palmitic acid amide, coconut fatty acid amide, etc; and various known recording sensitizers.

The amount to be used of the above recording sensitizers having the specific structure is not particularly limited but is usually 1 to 30 parts by weight, preferably 5 to 15 parts by weight per one part by weight of the diazonium salt.

Many compounds are known as a diazonium salt which is used with an auxiliary color former consisting of the above specific recording sensitizer. Examples thereof are complex salts of zinc chloride and chloride of the diazonium compound such as p-N,N-dimethylaminobenzenediazonium, 4-morpholino-2,5-dibutoxybenzenediazonium, 4-(4-methoxy)-benzylamino-2,5-diethoxybenzenediazonium, 4-morpholinobenzenediazonium, 4-pyrrolidino-3-methylbenzenediazonium, p-N-ethyl-N-hydroxyethylanilinediazonium, 4-benzamide-2,5-diethoxybenzenediazonium, 2-N,N-diethyl-m-toluidinediazonium, 6-morpholino-m-toluidinediazonium, 4-morpholino-2,5-diisopropoxybenzenediazonium, 4-morpholino-2,5-diethoxybenzenediazonium, etc.; borotetraphenyl salts, borotetrafluorides, phosphohexafluorides of the above diazonium compounds, etc.

As a coupler compound, any of known compound is used which forms an azoic color by the coupling reaction with a diazonium salt under a basic atmosphere. Examples of useful coupler compounds are resorcinol, catechol, phloroglucin, α-naphthol, 1,5-di-hydroxynaphthalene, 2,5-dimethyl-4-morpholinomethylphenol, sodium 1-hydroxynaphthalene-4-sulfonate, N-(3-morpholinopropyl)-3-hydroxy-2-naphthamide, 2-hydroxy-3-(β-hydroxyethyl-amidocarbonyl)naphthalene, 2-hydroxynaphthalene-3-carbonyl-diethanolamine, sodium 2-hydroxynaphthalene-3,6-disulfonate, acetoacetanilide, 4,4'-bisacertoaceto-o-toluidide, 3-methyl-5-pyrazolone, 1-phenyl-3-methyl-5-pyrazolone, 2-hydroxy-3-naphthoic acid-β-naphthylamide, 2-hydroxy-3-naphthoic acid-hydroxyethylamide, 2-hydroxy-3-naphthoic acid anilide, 2-hydroxy-3-naphthoic acid-m-nitroanilide, 2-hydroxy-3-naphthoic acid-p-chloroanilide, 2-hydroxy-3-naphthoic acid-o-ethoxyanilide, 2-hydroxy-3-naphthoic acid-2,5-dimethoxyanilide, 1-hydroxy-2-naphthoic acid anilide etc. These coupler compounds can be used singly or in admixture to form record images having a desired color.

The proportions of the diazonium salt and the coupler compound are varied depending on the kinds of the compounds used, but usually the coupler compound is used in an amount of about 0.1 to 10 parts by weight per one part by weight of the diazonium salt.

Examples of useful heat-fusible basic compounds are 1,3-diphenylguanidine, 1,3-di-o-tolylguanidine, 1,2,3-triphenylguanidine, 1,3-dicyclohexyl-2-phenylguanidine, benzimidazole, N,N'-diphenylformamidine, N,N'-di-o-tolylformamidine, N,N'-diphenylbenzamidine, N,N'-di-p-tolyl-N'-phenyl-benzamidine, N,N',N'',N'''-tetraphenylheptanediamidine, N,N',N'',N'''-tetraphenyl-terephthalamidine, etc. At least one of them is used. The amount of the heat-fusible basic compound is suitably decided depending on the kinds of the compound used, but is generally 1 to 30 parts by weight, more preferably 5 to 15 parts by weight per one part by weight of the diazonium salt.

In the invention is formed on a substrate a heat-sensitive recording layer which comprises a diazonium salt, coupler compound, heat-fusible basic compound and the above specific recording sensitizer, each compound being used singly or in mixture of at least two of them. The heat-sensitive recording layer is generally formed on the substrate by coating thereon a coating composition comprising the above-mentioned compounds.

To form the recording layer, the coating composition is applied to the substrate in one layer. Alternatively, at least one of these components and the rest thereof are each made into coating compositions, and the coating compositions are applied to the substrate in superposed layers, thereby providing the desired recording layer. In formulating the coating composition, the diazonium salt, coupler compound, heat-fusible basic compound and recording sensitizer of the formula [I] are dispersed in water separately or at the same time. These components may also be separately or conjointly dispersed or dissolved in an organic solvent to prepare a coating composition, so far as color forming reaction is not caused during preparation and application of the coating composition. The dispersing operation is performed with use of a stirring or pulverizing device such as a ball mill, attritor, sand mill and the like. Examples of organic solvents are ethanol, n-hexane, ethyl acetate, benzene, toluene, etc.

To the coating composition are added, as desired, a preservative such as sodium naphthalenesulfonate, sodium naphthalenedisulfonate, sulfoasalicylic acid, magnesium sulfate, zinc chloride, etc; antioxidant such as thiourea, diphenyl thiourea, urea, etc; stabilizer such as citric acid, malic acid, tartaric acid, phosphoric acid, saponin, etc; water-soluble or water-insoluble adhesive such as starches, casein, gum arabic, polyvinyl alcohols, polyvinyl acetate emulsion, SBR latex, etc; pigment such as silica, clay, barium sulfate, titanium oxide, calcium carbonate, etc.

The coating composition obtained as above is applied to a suitable substrate such as paper, plastic film, synthetic fiber sheet, metal film, etc. The coating method is not particularly limited and the composition is applied by an air knife coater, roll coater, blade coater, short dwell coater or like suitable means in an amount of usually 3 to 10 g/m$^2$ based on dry weight and dried thereafter.

The heat-sensitive recording material of the invention has an improved high-speed recording sensitivity without affecting an excellent storage stability.

In the heat-sensitive recording material of the invention, record images are formed as usual with a thermal pen, thermal head or the like, and ultraviolet rays are irradiated thereto by use of luminescent lamp, mercury lamp or the like to decompose the unreacted diazonium salt in the unrecorded portion and fix the record images.

The invention will be described below in more detail with reference to Examples and Comparison Examples by no means limited to, in which parts and percentages are all by weight, unless otherwise specified.

EXAMPLE 1

(1) Composition (A)

4-Morpholino-2,5-diethoxybenzenediazonium borotetraphenyl salt (2 parts), 50 parts of calcium carbonate, 50 parts of 10% aqueous solution of polyvinyl alcohol and 100 parts of water were pulverized by a sand mill to prepare Composition (A) having an average particle size of 3 μm.

(2) Composition (B)

2-Hydroxy-3-naphthoic acid anilide (10 parts), 20 parts of N,N′,N″,N‴-tetraphenyl-terephthalamidine, 25 parts of 1,4-diphenoxybutane, 50 parts of 10% aqueous solution of polyvinyl alcohol and 150 parts of water were pulverized by a sand mill to prepare Composition (B) having an average particle size of 3 μm.

(3) Preparation of a recording layer

A 202-part quantity of Composition (A) and 255 parts of Composition (B) were mixed with stirring to prepare a coating composition. The coating composition was applied by a Mayer bar to a paper substrate weighing 49 g/m$^2$ in an amount of 7 g/m$^2$ by dry weight to prepare a heat-sensitive recording paper.

EXAMPLES 2 TO 16

Fifteen kinds of heat-sensitive recording papers were prepared in the same manner as in Example 1 except that, in the preparation of Composition (B), 1,4-di(4-methylphenoxy)butane (Example 2), 1,2-di(3-methylphenoxy)ethane (Example 3), 1-(2-chlorophenoxy)-2-phenoxyethane (Example 4), phenoxyacetanilide (Example 5), 1-(4-chlorophenoxy)-2-phenoxyethane (Example 6), 1-(4-methoxyphenoxy)-2-phenoxyethane (Example 7), 1-(4-chlorophenoxy)-2-(4-tert-butylphenoxy)ethane (Example 8), 1,2-diphenoxyethane (Example 9), 1-(4-ethylphenoxy)-2-phenoxyethane (Example 10), 1-(4-ethylphenoxy)-2-(3-methylphenoxy)ethane (Example 11), 1-(4-isopropylphenoxy)-2-(4-methylphenoxy)ethane (Example 12), 1-(4-tert-butylphenoxy)-2-(2-methylphenoxy)ethane (Example 13), 1-(2-phenylphenoxy)-2-phenoxyethane (Example 14), 1-(4-phenylphenoxy)-3-phenoxypropane (Example 15) and 1-(4-ethoxyphenoxy)-2-phenoxyethane (Example 16) were used respectively in place of 1,4-diphenoxybutane.

EXAMPLE 17

A heat-sensitive recording paper was prepared in the same manner as in Example 1 except that, in the preparation of Composition (B), N,N′-diphenyl benzamidine and 1-(4-chlorophenoxy)-2-phenoxyethane were used respectively in place of N,N′,N″,N‴-tetraphenyl-p-xylenediamidine and 1,4-diphenoxybutane.

EXAMPLE 18

A heat-sensitive recording paper was prepared in the same manner as in Example 17 except that, in the preparation of Composition (B), 1,2-di(3-methylphenoxy)ethane was used in place of 1-(4-chlorophenoxy)-2-phenoxyethane.

COMPARISON EXAMPLE 1

A heat-sensitive recording paper was prepared in the same manner as in Example 1 except that, in the preparation of Composition (B), 1,4-diphenoxybutane was not used.

COMPARISON EXAMPLE 2

A heat-sensitive recording paper was prepared in the same manner as in Example 1 except that, in the preparation of Composition (B), stearic acid amide was used in place of 1,4-diphenoxybutane.

The 20 kinds of heat-sensitive recording papers thus prepared were checked for recording properties and storage stability. The results were shown in Table 1.

RECORDING PROPERTIES (a) Recording temperature

The heat-sensitive recording paper was pressed to a plate heated at a prescribed temperature at a pressure of 100 g/cm$^2$ for 3 seconds to produce record images. The images were fixed with irradiation of ultraviolet rays and checked for color density by Macbeth densitometer with use of a yellow filter. A temperature was determined as recording temperature which gives a color density corresponding to half of the maximum color density.

(b) Recording sensitivity

The heat-sensitive recording paper was printed by a thermal head (pulse width 1 ms, electric power 0.7 W/dot) to produce record images. The record images were fixed with irradiation of ultraviolet rays and checked for color density by Macbeth densitometer to determine recording sensitivity.

STORAGE STABILITY

A heat-sensitive recording paper just prepared was allowed to stand at 40° C. and 90% RH for 2 days at a dark place. The recording layer was checked for coloring with an unaided eye.

In the table,

: The recording layer hardly color

: The recording layer slightly color but practically no problem

×: The recording layer considerably color and practically problem

TABLE 1

| | Recording properties | | |
|---|---|---|---|
| | recording temp (°C.) | recording sensitivity | storage stability |
| Ex. 1 | 80 | 0.92 | |
| Ex. 2 | 81 | 0.93 | |
| Ex. 3 | 81 | 0.94 | |
| Ex. 4 | 74 | 0.93 | |
| Ex. 5 | 76 | 0.95 | |
| Ex. 6 | 75 | 0.96 | |
| Ex. 7 | 75 | 0.95 | |
| Ex. 8 | 83 | 0.92 | |
| Ex. 9 | 79 | 0.93 | |
| Ex. 10 | 82 | 0.93 | |
| Ex. 11 | 82 | 0.93 | |
| Ex. 12 | 84 | 0.91 | |
| Ex. 13 | 79 | 0.92 | |
| Ex. 14 | 78 | 0.93 | |
| Ex. 15 | 78 | 0.93 | |
| Ex. 16 | 81 | 0.93 | |
| Ex. 17 | 87 | 0.97 | |
| Ex. 18 | 85 | 0.98 | |
| Comp. Ex. 1 | 95 | 0.77 | |
| Comp. Ex. 2 | 74 | 0.94 | X |

What is claimed is:

1. A heat-sensitive recording material comprising a substrate and a heat-sensitive recording layer thereon; said heat-sensitive recording layer comprising a light-sensitive diazonium salt, a coupler compound reactive with said diazonium salt in the presence of a fused basic compound to form a color, a heat-fusible basic compound and a recording sensitizer;

wherein said recording sensitizer comprises at least one compound represented by the formula (I)

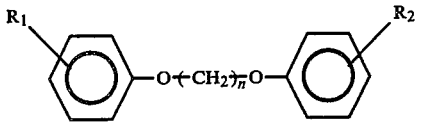

wherein $R_1$ and $R_2$ are each hydrogen, chlorine, alkyl having 1 to 4 carbon atoms, phenyl, benzyl or alkoxy having 1 to 4 carbon atoms and n is an integer of 1 to 4; and wherein said coupler compound is present in an amount of about 0.1 to 10 parts by weight per one part by weight of said diazonium salt; said heat-fusible basic compound is present in an amount of about 1 to 30 parts by weight per one part by weight of said diazonium salt; and said recording sensitizer is present in an amount of about 1 to 30 parts by weight per one part by weight of said diazonium salt.

2. The heat-sensitive recording material according to claim 1, wherein said heat-sensitive recording layer comprises a single layer comprising an admixture of said diazonium salt, said coupler component, said heat-fusible basic compound and said recording sensitizer.

3. The heat-sensitive recording material according to claim 1, wherein said heat-sensitive recording layer comprises a first layer comprising at least one of said diazonium salt, said coupler component, said heat-fusible basic compound or said recording sensitizer and at least one superposed additional layer comprising the remainder of said diazonium salt, said coupler component, said heat-fusible basic compound or said recording sensitizer.

4. The heat sensitive recording material according to claim 1, wherein n is 2.

* * * * *